US006082447A

United States Patent [19]

Insalaco et al.

[11] Patent Number: 6,082,447

[45] Date of Patent: Jul. 4, 2000

[54] HEAT EXCHANGER MEMBER AND BAFFLE INSTALLATION METHOD THEREFOR

[75] Inventors: Jeffrey Lee Insalaco; Cowley Wendell Phillips, Jr., both of Brandon, Miss.

[73] Assignee: Norsk Hydro A.S., Oslo, Norway

[21] Appl. No.: 09/193,108

[22] Filed: Nov. 16, 1998

[51] Int. Cl.[7] ..... F28F 9/02

[52] U.S. Cl. ..... 165/174; 165/176; 165/DIG. 416; 165/DIG. 483; 165/153

[58] Field of Search ..... 165/173, 174, 165/176, DIG. 482, DIG. 416, 153

[56] References Cited

U.S. PATENT DOCUMENTS

| | | | |
|---|---|---|---|
| 4,936,381 | 6/1990 | Alley | 165/176 |
| 4,960,169 | 10/1990 | Granetzke | 165/173 |
| 5,080,167 | 1/1992 | Wolf | 165/140 |
| 5,123,483 | 6/1992 | Tokutake et al. | 165/174 |
| 5,183,107 | 2/1993 | Le Gauyer | 165/176 |
| 5,186,245 | 2/1993 | Peters | 165/140 |
| 5,186,246 | 2/1993 | Halstead | 165/140 |
| 5,316,079 | 5/1994 | Hedeen | 165/140 |
| 5,318,111 | 6/1994 | Young et al. | 165/150 |
| 5,329,995 | 7/1994 | Dey et al. | 165/153 |
| 5,526,873 | 6/1996 | Marsais et al. | 165/51 |
| 5,544,700 | 8/1996 | Shagoury | 165/139 |
| 5,551,505 | 9/1996 | Freeland | 165/41 |
| 5,607,012 | 3/1997 | Buchanan et al. | 165/173 |
| 5,934,366 | 8/1999 | Gowan | 165/174 |
| 5,947,196 | 10/1990 | Halm et al. | 165/173 |

*Primary Examiner*—Ira S. Lazarus
*Assistant Examiner*—Terrell McKinnon
*Attorney, Agent, or Firm*—Gary M. Hartman; Domenica N. S. Hartman

[57] ABSTRACT

A heat exchanger member (12) having an internal passage in which a baffle assembly (14) is received to define at least two separate flow regions within the passage. The baffle assembly (14) includes a pair of baffles (18, 26), a first (18) of which having a first peripheral portion (22) contacting the wall (16) of the heat exchanger member (12) so as to form a fluid-tight seal therebetween. The first baffle (18) further has a second peripheral portion (24) spaced apart from the wall (16) of the heat exchanger member (12) so as to form a peripheral gap (32) therebetween. The second (26) of the two baffles also has a peripheral portion (30) contacting the wall (12) of the heat exchanger member (12) so as to form a fluid-tight seal therebetween. A second peripheral portion (30) of the second baffle (26) contacts the second peripheral portion (24) of the first baffle (18) so that the baffles (18, 26) are joined together as an assembly. In a preferred embodiment, the peripheral gap (32) between the first and second baffles (18, 26) is vented to atmosphere through an opening (34). As a result, the flux can be introduced and removed from the heat exchanger member (12) through the opening (34) for brazing the baffles (18, 26) in place. Leakage through the opening (34) can serve to indicate failure of the baffles (18, 26) anytime after their installation.

12 Claims, 1 Drawing Sheet

HEAT EXCHANGER MEMBER AND BAFFLE INSTALLATION METHOD THEREFOR

BACKGROUND OF THE INVENTION

1. Field of the Invention

The present invention generally relates to heat exchanger construction and assembly methods. More particularly, this invention relates to a baffle assembly and method for creating at least two isolated fluid circuits within a heat exchanger.

2. Description of the Prior Art

Baffles are used in a variety of applications to block and direct the flow of fluids and gases through tubular members, such as a manifold of a heat exchanger. Heat exchangers typically include tubes interconnected between a pair of manifolds. To optimize heat transfer efficiency, the flow of a heat transfer fluid (gas or liquid) through the tubes is often controlled by placing baffles at certain points within the manifolds, such that separate and parallel flow regions can be established within the heat exchanger by appropriately routing the fluid through its tubes.

The prior art has suggested various baffle designs and methods for installing baffles within heat exchanger manifolds. One example is to use cup-shaped baffles that are installed within the internal passage of a manifold and then brazed in place. Brazing is desirable for forming a high-strength, fluid-tight seal with a baffle, particularly if the heat exchanger has a brazed construction. However, a difficulty with this approach is that braze flux may remain trapped within the manifold, which can corrode the interior of the heat exchanger. Another example is disclosed in U.S. Pat. No. 5,052,478 to Nakajima et al., which teaches the insertion of partitioning plates through circumferential slots formed in the wall of a heat exchanger manifold. Though the slots facilitate removal of residual braze flux from the manifold, they can substantially weaken the manifold wall, reducing its capacity to withstand numerous temperature and pressure cycles. A baffle design and installation method that does not compromise the structural integrity of a heat exchanger manifold and avoids braze flux contamination is disclosed in commonly-assigned U.S. Pat. No. 4,762,152 to Clausen, which uses a cup-shaped baffle that is installed with a tool that forces the sidewalls of the baffle radially outward as the tool is withdrawn. In so doing, the sidewall is forced against the inner surface of the manifold, thus plastically deforming the baffle and manifold to secure the baffle in place.

In addition to routing fluids through heat exchangers, baffles have been employed to create two or more isolated fluid circuits within a single heat exchanger unit. The ability to provide multiple fluid circuits with a single heat exchanger is particularly desirable where efficient use of space is important, as in the case of automotive applications. In such applications, it becomes more important that each baffle is able to form a fluidic seal capable of surviving numerous thermal and pressure cycles, especially if intermixing of the fluids can damage the components of the separate fluid circuits. However, the sealing capability of a baffle can be severely challenged if the fluid circuits operate at significantly different pressures within the heat exchanger. For example, the integration of an air conditioning condenser and oil cooler within a single heat exchanger unit is made difficult by the fact that automotive air conditioning fluids are compressed to significantly higher pressures than peak engine oil pressures. Therefore, a baffle required for this purpose must be capable of withstanding a much higher pressure on the condenser side throughout numerous thermal and pressure cycles, and failure of the baffle is likely to result in damage to the air conditioning and engine oil systems.

Accordingly, it can be seen that if isolated fluid circuits operating at significantly different pressures are desired within a single heat exchanger unit, the baffles used to create the fluid circuits must provide reliable fluid-tight seals over many thermal and pressure cycles. In view of the prior art, an improved baffle design is required that does not compromise the structural integrity of the manifold or encourage entrapment of braze flux within the manifold.

SUMMARY OF THE INVENTION

It is an object of this invention to provide a heat exchanger member with a baffle that defines separate flow regions within the member.

It is another object of this invention that such a baffle is able to reliably separate and seal fluids operating at different pressures within the heat exchanger member.

It is a further object of this invention that such a baffle can be brazed within the heat exchanger member, facilitates placement and removal of braze flux around the baffle, and can be individually leak checked.

According to the present invention, there is provided a heat exchanger member having an internal passage in which a baffle assembly is received to define at least two separate flow regions within the passage. The baffle assembly includes a pair of baffles, a first of which having a first peripheral portion contacting the wall of the heat exchanger member so as to form a fluid-tight seal therebetween. The first baffle further has a second peripheral portion spaced apart from the wall of the heat exchanger member so as to form a peripheral gap therebetween. The second of the two baffles also has a peripheral portion contacting the wall of the heat exchanger member so as to form a fluid-tight seal therebetween. A second peripheral portion of the second baffle contacts the second peripheral portion of the first baffle so that the baffles are joined together as an assembly. In a preferred embodiment, the peripheral gap between the first and second baffles is vented to atmosphere through an opening. As a result, the flux can be introduced and removed from the heat exchanger member through the opening for brazing the baffles in place. Furthermore, the opening can serve as a point of leak testing the baffles after installation and, if not sealed following manufacture of the heat exchanger, can also serve to indicate a failure of one of the baffles. Because the opening prevents the build up of fluid pressure within the gap, the opening also prevents intermixing of the two fluids within the separate flow regions.

In view of the above, it can be seen that a significant advantage of this invention is that an improved baffle design is provided that enables two or more isolated fluid circuits to be defined within a single heat exchanger unit. The baffle design is capable of separating fluids at significantly different pressures, such as automotive air conditioning fluid and engine oil, over numerous pressure and temperature cycles. In addition, the baffle design facilitates brazing and testing of the heat exchanger unit, and prevents intermixing of the different fluids if leakage were to occur past one or both of the baffles.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
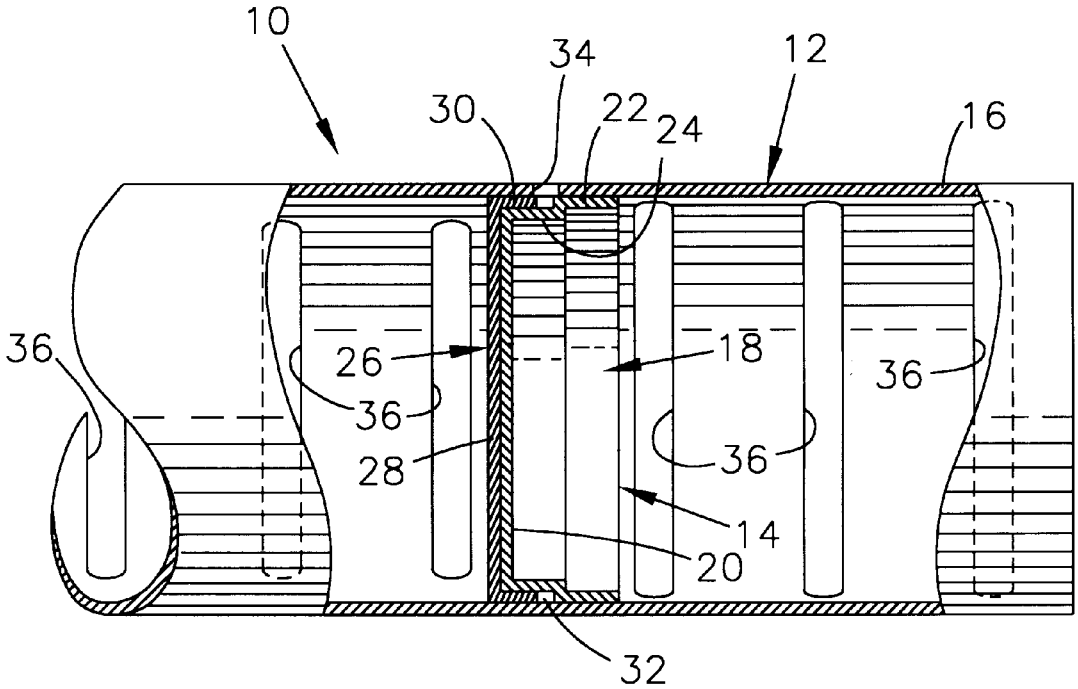
FIG. 1 is a cross-sectional view of a heat exchanger manifold with a baffle assembly in accordance with this invention.

Shown in cross-section in FIG. 1 is a portion of a heat exchanger unit 10, including a manifold 12 and a baffle assembly 14. According to this invention, the baffle assembly 14 is capable of separating two fluids within the manifold 12. A particular aspect of the invention is that the baffle assembly 14 can reliably isolate two fluids though one of the fluids is at a much higher pressure than the other. An example of such an application is a heat exchanger unit intended to have one cooling circuit operating as a condenser for an automotive air conditioning system, and a second cooling circuit operating as an oil cooler for an engine oil system. However, those skilled in the art will appreciate that other applications, including those outside the automotive industry, are possible with this invention.

The baffle assembly 14 includes a pair of baffles 18 and 26 that are nested together as shown. The assembly 14 is positioned within the manifold 12 between a pair of adjacent tube openings 36, each of which carries fluid for one of the fluid circuits defined by the baffle assembly 14. The baffle 18 is generally intended to be placed on the high-pressure side of the manifold 12, while the baffle 26 is intended for lower pressure operation. The baffle 18 is generally cup-shaped with a radial wall 20, an outer annular portion 22, and an inner annular portion 24 connecting the outer annular portion 22 to the radial wall 20. The outer annular portion 22 is brazed or otherwise joined to the wall 16 of the manifold 12 to form a fluid-tight seal. The radial wall 20 and inner annular portion 24 are spaced apart from the wall 16, so that an annular gap 32 is formed. The second baffle 26 is also generally cup-shaped and has a radial wall 28 and an annular portion 30. The annular portion 30 is brazed or otherwise joined to the wall 16 of the manifold 12 so as to form a fluid-tight seal therebetween. The baffle 26 is preferably press-fit or otherwise attached or joined to the baffle 18 so that annular portion 30 of the baffle 28 surrounds and contacts the inner annular portion 24 of the baffle 18. In this manner, the baffles 18 and 26 fluidically seal the annular gap 32 from the two fluid circuits defined within the manifold 12 by the baffle assembly 14.

From the configuration of the baffles 18 and 26 shown in FIG. 1, it can be seen that fluid pressure applied to the baffle 18 tends to expand the outer annular portion 22 into greater contact with the wall 16 of the manifold 12. As a result, the baffle 18 is preferably positioned on the higher-pressure side of the two fluid circuits. The inner annular portion 24 also expands but to a lesser extent, providing increased contact pressure between the inner annular portion 24 and the annular portion 30 of the baffle 26, and between the annular portion 30 and the manifold wall 16.

In accordance with a preferred embodiment of this invention, an opening 34 is present in the wall 16 of the manifold 12 so that the annular gap 32 is vented. As a result, any leakage past one of the baffles 18 and 26 will be evident by seepage from the opening 34. Accordingly, the opening 34 is able to serve as a leak test point after the baffle assembly 14 has been installed in the manifold 12 and any time after assembly of the heat exchanger unit 10 has been completed, including after the unit 10 is placed in service. Notably, failure of one baffle does not encourage failure of the remaining baffle because the opening 34 prevents pressurization of any fluid within the annular gap 32. As a result, the opening 34 prevents the fluids separated by the baffle assembly 14 from intermixing. The opening 34 also provides access to the baffles 18 and 26 for purposes of introducing and/or removing brazing flux if the baffles 18 and 26 are brazed to the manifold wall 16. As a result, the likelihood that braze flux will remain trapped within the manifold 12 after the brazing operation is significantly reduced.

Installation of the baffle assembly 14 within the manifold 12 is preferably accomplished by press-fitting the baffle 26 onto the baffle 18, after which the baffles 18 and 26 are installed as a unit into the manifold 12. If the assembly 14 is to be brazed in place, the baffles 18 and 26 are both preferably formed of a suitable aluminum alloy clad with a braze alloy. Clearance is provided between the baffles 18 and 26 and the wall 16 of the manifold 12 to facilitate installation of the assembly 14. Materials, clearances and installation tooling suitable for use with this invention are all well known in the art, and therefore will not be discussed in further detail here.

While the invention has been described in terms of a preferred embodiment, it is apparent that other forms could be adopted by one skilled in the art. For example, the opening 34 could be sealed following leak testing. Furthermore, the baffles 18 and 26 could be integrally formed, instead of being separately formed and then assembled. Accordingly, the scope of the invention is to be limited only by the following claims.

What is claimed is:

1. A heat exchanger member having an internal passage defined by at least one wall, the heat exchanger member comprising:

a first baffle member received in the internal passage and defining a first flow region of at least two separate flow regions within the internal passage, the first baffle member having a first peripheral portion contacting the wall of the heat exchanger member so as to form a fluid-tight seal therebetween, the first baffle member having in a second peripheral portion spaced apart from the wall of the heat exchanger member so as to form a peripheral gap therebetween; and a second baffle member received in the internal passage and defining a second flow region of the at least two separate flow regions within the internal passage, the second baffle member having a first peripheral portion contacting the wall of the heat exchanger member so as to form a fluid-tight seal therebetween, the second baffle member having a second peripheral portion contacting the second peripheral portion of the first baffle member, the first and second baffle members fluidically sealing the peripheral gap from the first and second flow regions.

2. A heat exchanger member as recited in claim 1, further comprising an opening through the wall of the heat exchanger member and in fluidic communication with the peripheral gap.

3. A heat exchanger member as recited in claim 1, wherein the first peripheral portion of the first baffle member is annular-shaped.

4. A heat exchanger member as recited in claim 1, wherein the second peripheral portion of the first baffle member is annular-shaped.

5. A heat exchanger member as recited in claim 1, wherein the first peripheral portion of the second baffle member is annular-shaped.

6. A heat exchanger member as recited in claim 1, wherein the second peripheral portion of the second baffle member is annular-shaped.

7. A heat exchanger member as recited in claim 1, wherein the first and second peripheral portions of the second baffle member are defined by radially inward and radial outward surface regions of an annular-shaped portion of the second baffle member.

8. A heat exchanger member as recited in claim 1, wherein the first peripheral portion of the first baffle member is brazed to the wall of the internal passage.

9. A heat exchanger member as recited in claim 1, wherein the first peripheral portion of the second baffle member is brazed to the wall of the internal passage.

10. A heat exchanger member as recited in claim 1, wherein the second peripheral portion of the second baffle member is press-fit onto the second peripheral portion of the first baffle member.

11. A heat exchanger member as recited in claim 1, wherein the heat exchanger member is a manifold of a heat exchanger.

12. A heat exchanger having a manifold with an internal passage defined by a wall of the manifold, the heat exchanger comprising:

a cup-shaped first baffle within the internal passage, the first baffle having a radial wall, a first annular portion, and a second annular portion connecting the first annular portion to the radial wall, the first annular portion being joined to the wall of the manifold so as to form a fluid-tight seal therebetween, the radial wall and the second annular portion being spaced apart from the wall of the manifold so as to form an annular gap therebetween;

a cup-shaped second baffle within the internal passage and nested with the first baffle so as to define two fluidically-isolated fluid circuits within the heat exchanger, the second baffle having a radial wall and an annular portion, the annular portion being joined to the wall of the manifold so as to form a fluid-tight seal therebetween, the second annular portion of the first baffle being press-fit with the annular portion of the second baffle so as to form a fluid-tight seal therebetween, the first and second baffles fluidically sealing the annular gap from the two fluidically-isolated fluid circuits; and an opening through the wall of the heat exchanger member and in fluidic communication with the annular gap.

* * * * *